US005471185A

United States Patent [19]

Shea et al.

[11] Patent Number: 5,471,185

[45] Date of Patent: Nov. 28, 1995

[54] ELECTRICAL CIRCUIT PROTECTION DEVICES COMPRISING CONDUCTIVE LIQUID COMPOSITIONS

[75] Inventors: John J. Shea, Pittsburgh; James D. B. Smith, Monroeville; Karl F. Schoch, Jr., Pittsburgh, all of Pa.

[73] Assignee: Eaton Corporation, Cleveland, Ohio

[21] Appl. No.: 350,291

[22] Filed: Dec. 6, 1994

[51] Int. Cl.[6] ..... H01H 29/00

[52] U.S. Cl. ..... 335/51; 200/211; 335/47; 335/49

[58] Field of Search ..... 335/29, 47–58; 200/182, 185, 193, 194, 211, 233, DIG. 30, DIG. 41; 338/27, 36, 38, 44, 80, 222

[56] References Cited

U.S. PATENT DOCUMENTS

| | | | |
|---|---|---|---|
| 3,177,327 | 4/1965 | Weiss | 200/211 |
| 3,341,676 | 9/1967 | Schwarz | 200/211 |
| 3,750,067 | 7/1973 | Fletcher et al. | 335/296 |

OTHER PUBLICATIONS

Yoshino, K., Novel Electrical and Optical Properties of Liquid Conducting Polymers and Oligomers, IEEE Transactions on Dielectrics and Electrical Insulation, vol. 1, No. 3, Jun. 1994, pp. 353–364.

*Primary Examiner*—Leo P. Picard

*Assistant Examiner*—Ramon M. Barrera

*Attorney, Agent, or Firm*—Martin J. Moran

[57] ABSTRACT

The invention provides an electrical circuit protection device using a conductive liquid contained in a flexible tube contacted and sealed at each end by an annular metal electrode capped by a flexible membrane. The flexible tube is further sealed inside a solid insulating tube which contains a ferromagnetic liquid. The ferromagnetic liquid surrounds the flexible tube and remains in intimate contact with the outside of the flexible tube and is connected to a load sensing element which generates a magnetic field in the ferromagnetic fluid in response to excessive currents applied in the current path through the conductive liquid between the electrodes. This assembly is contained inside a tubular resistor. Under normal current conditions, a current flows through the conductive liquid which has relatively low resistivity. Upon a fault condition, a self generated magnetic field from the fault current causes the ferromagnetic fluid to rapidly constrict and pinch off current flow in the conductive liquid by constricting the current path in the liquid through deformation of the flexible capsule, i.e., by radial contraction and axial expansion. The current is then preferably commutated to the cylindrical resistor to limit the let through current to a safe value. Once the fault is limited, the magnetic field is dissipated and the flexible membranes force the conductive liquid and ferromagnetic fluid back to its their original position and the conductive liquid accordingly automatically reverts back to low resistivity for normal current conduction.

31 Claims, 5 Drawing Sheets

ELECTRICAL CIRCUIT PROTECTION DEVICES COMPRISING CONDUCTIVE LIQUID COMPOSITIONS

FIELD OF THE INVENTION

The invention generally relates to the field of electrical circuit protection devices, and in particular to electrical circuit protection devices comprising conductive liquid compositions which exhibit a switching from conductance to resistance during fault current conditions. The invention has specific applications as automatically resettable fuses or current limiters in electrical power distribution components. The circuit protection device is preferably used to limit a current at 600 volts or lower, i.e., low voltage applications.

When used in an electrical circuit, the conductive liquid composition contained in the circuit protection device carries a normal current under steady-state conditions. When the current, however, excessively increases due to overload or short circuit conditions, i.e., a fault current, the current path through the conductive liquid composition of the electrical circuit protection device switches from a state of conductance to resistance to reduce the let through current to a safe value. When the excessive current is removed the current path through the conductive liquid composition automatically reverts back to its original state of conductance.

BACKGROUND OF THE INVENTION

Current limiting power interruption requires a current interruption device that rapidly and effectively brings the current to a low or zero value upon the occurrence of a line fault or overload conditions.

Circuit protection devices protect electrical equipment from damage when excess current flows in the circuit due to overload or short circuit conditions. Such devices have a relatively low resistivity and, accordingly, high conductivity under normal current conditions of the circuit but are "tripped" or converted to high or complete resistivity when excessive current and/or temperature occurs. When the device is tripped, a reduced or zero current is allowed to pass in the circuit, thereby protecting the wires and load from electrical and thermal damage until the overload or fault is removed.

Conventional circuit protection or current limiting devices include, but are not limited to, circuit breakers, fuses, e.g., expulsion fuses, thermistors, e.g., PTC (Positive Temperature Coefficient) conductive polymer thermistors, and the like. These devices are current rated for the maximum current the device can carry without interruption under a load.

Circuit breakers typically contain a load sensing element, e.g., a bimetal, hot-wire, or magnetic element, and a switch which opens under overload or short circuit conditions. Most circuit breakers have to be reset manually at the breaker site or via a remote switch.

Fuses typically contain a load sensing fusible element, e.g., metal wire, which when exposed to current of fault magnitude rapidly melts and vaporizes through resistive heating ($I^2R$). Formation of an arc in the fuse, in series with the load, can introduce arc resistance into the circuit to reduce the peak let-through current to a value significantly lower than the fault current. Expulsion fuses may further contain gas-evolving or arc-quenching materials which rapidly quench the arc upon fusing to eliminate current conduction. Fuses generally are not reusable and must be replaced after overload or short circuit conditions because they are damaged inherently, when the circuit opens.

Various fusible elements, gas-evolving materials and fuses are shown for example in U.S. Pat. Nos. 2,526,448; 3,242,291; 3,582,586; 3,761,660; 3,925,745; 4,008,452; 4,035,755; 4,099,153; 4,166,266; 4,167,723; 4,179,677; 4,251,699; 4,307,368; 4,309,684; 4,319,212; 4,339,742; 4,340,790; 4,444,671; 4,520,337; 4,625,195; 4,638,283; 4,778,958; 4,808,963; 4,950,852; 4,952,900; 4,975,551; and, 4,995,886.

The resistance of a circuit element such as a fuse is a matter of its material and its dimensions. Resistance along the circuit path decreases with increasing cross-sectional area. Thus resistive heating of the circuit element, which is a function of current and resistance according to $I^2R$, is a function of current density. In a typical fuse, the fusible element has a small cross-sectional area along the direction of current flow, so as to concentrate heating at the fusible element, and comprises a low melting temperature material.

Thermistors are a particularly useful type of circuit protection devices that employ heating, especially positive temperature coefficient (PTC) conductive polymer thermistors. PTC conductive polymers typically comprise a polymer, e.g., a thermoplastic, thermoset, or elastomeric polymer, having conductive particles, e.g., carbon black, graphite, metal, or metal oxide, dispersed in the polymer matrix. PTC conductive polymers have low resistivity under normal current conditions, but due to the positive temperature coefficient of their resistance, undergo an exponential increase in resistivity as their temperature rises through resistive heating ($I^2R$) caused by fault current. The resistance becomes substantial over a particular current and/or temperature value which is referred to as the switching temperature or anomaly temperature. PTC conductive polymers can be placed in series with a load, thereby introducing increased resistance into the circuit to reduce the peak let through current to a value significantly lower than the fault current.

Once the fault current dissipates, the PTC conductive polymer material cools and reverts back to its original low resistivity. Accordingly the PTC conductive polymer is automatically resettable over a number of thermal cycles to provide a reusable circuit protection device. However, PTC conductive polymer devices are subject to degradation as a result of material resistivity changes over thermal cycles.

Various PTC conductive polymers and thermistors are shown for example in U.S. Pat. Nos. 2,952,761; 2,978,665; 3,243,753; 3,351,882; 3,571,777; 3,757,086; 3,793,716; 3,823,217; 3,858,144; 3,861,029; 3,950,604; 4,017,715; 4,072,848; 4,085,286; 4,117,312; 4,177,376; 4,177,446; 4,188,276; 4,237,441; 4,242,573; 4,545,926; 4,647,894; 4,685,025; 4,724,417; 4,774,024; 4,775,778; 4,857,880; 4,910,389; 5,049,850; and, 5,195,013.

What is needed is an improved automatically resettable electrical circuit protection device with improved circuit interrupting capacity and longer life.

SUMMARY OF THE INVENTION

It is an object of the invention to provide an electrical circuit protection device which comprises conductive liquid compositions.

It is another object of the invention to provide an electrical circuit protection device which comprises a flexibly encapsulated conductive liquid composition generally surrounded by a ferromagnetic fluid as an electromechanical actuator.

It is still another object of the invention to provide automatically resettable electrical circuit protection devices having a long life over a plurality of fault cycles and environmental conditions.

This invention provides a novel electrical circuit protection or current limiting device which has many technical advantages over the current state of the art. The circuit protection device includes a conductive liquid composition contained within an elongated and flexible and resilient capsule which is closed at each end by annular metal electrodes capped by flexible membranes. The electrodes are provided in intimate contact with the conductive liquid composition, and electrically connect the conductive liquid composition to the electrical circuit so as to conduct current between the electrodes through the conductive liquid. Means are also provided controllably to compress the capsule containing the conductive liquid to thereby constrict the cross-sectional area of the conductive liquid and therefore the current path between the electrodes. The reduction of cross-sectional area and possibly heating with increased current density in the constricted area are such that the resistance between the electrodes increases sharply as the compressive pressure rises above a particular value, herein referred to as the switching pressure, and correspondingly as the cross-sectional area of the conductive liquid composition lowers below a particular value, herein referred to as the switching cross-sectional area.

The flexible capsule is contained inside an elongated and sealed solid walled housing which contains the means for controllably deforming the flexible capsule, preferably a ferromagnetic fluid that fills the interior of the housing. The ferromagnetic fluid, accordingly, surrounds the flexible capsule containing the conductive liquid and remains in intimate contact with the outside of the flexible capsule. Means are also provided for generating a magnetic field in the ferromagnetic fluid in response to an electrical current, the magnetic field causing a redistribution of the ferromagnetic fluid to provide a constriction force on the flexible capsule. The means for generating the magnetic field preferably includes the current flowing through the conductive liquid, but can also include a coil disposed in the ferromagnetic fluid along the length of the flexible capsule and connected to the electrodes. This assembly is further connected to or contained inside an elongated resistor electrically connected to the electrodes and capable of absorbing high energies. The device also preferably includes commutation means, such as auxiliary contacts or switch electrically connected in series to the electrodes and the resistor although the commutation means can be constriction alone.

When the circuit protection device is connected to an electrical circuit, the current flows through the conductive liquid composition with relatively low resistance under normal steady-state current conditions. But when the circuit protection device is tripped under a fault current condition, i.e., excessive current due to overload or short circuit, the current path through the conductive liquid composition, i.e., through the circuit protection device, is rapidly converted by constriction to a state of relatively high resistance. The excessive fault current at a particular current value, herein referred to as the trip current, generates a magnetic field that causes the ferromagnetic fluid to act as an electromechanical actuator through a redistribution of the ferromagnetic fluid generally in the direction of the magnetic flux, i.e., transverse to the current flow along the length of the flexible capsule. The redistribution of the ferromagnetic fluid, consequently, exerts a compression or deformation force on the flexible capsule and the conductive liquid in the flexible capsule, i.e., by radial contraction and axial expansion, thereby constricting the current path through the conductive liquid between the electrodes, such that the conductive liquid transforms to a state of relatively high resistance. The current is then preferably commutated by commutation means to a shunt resistor to limit the let through current to a safe value. Variation of the current will produce a corresponding variation in the degree of capsule deformation and, consequently, variation in the amount of shunt regulation. When the fault current is removed, the magnetic field is dissipated, the ferromagnetic fluid reverts to a uniform distribution and the deformation of the flexible capsule is relaxed, such that the conductive liquid automatically reverts to its relatively low resistance state where normal steady-state current again conducts through the liquid. This arrangement provides an automatically resettable current limiter of the invention.

The conductive liquid compositions contained within the flexible capsule between the electrodes can be, for example, conductive particle dispersions, conductive ionic solutions, conductive polymer solutions, and conductive liquid metals or combinations thereof. The quantity of the electrically conductive liquid is switched in conductivity or resistance between the electrodes when subjected to an effective amount of constriction of the capsule transverse to the flow of electrical current between the electrodes. The resistance is increased by the decrease in cross-sectional area at the constriction, and also possibly by positive temperature heating enhanced by increased current density at the constriction.

This electrical circuit protection device of the invention can be used alone in an electrical circuit to create current limiting ability. The device of the invention can also be used, for example, in an electrical circuit in conjunction with a conventional circuit breaker device by being placed inside a conventional circuit breaker to create or enhance the current limiting capability of the breaker. Other applications will become apparent from this disclosure or from the practice of the invention.

The invention resides in an electrical circuit protection device or current limiter which is characterized by: (A) a flexible and preferably elongated capsule, e.g., an elastomeric capsule, having a length and two ends; (B) a quantity of a conductive liquid composition, e.g., conductive particle dispersions, conductive ionic solutions, conductive polymer solutions, and conductive liquid metals or combinations thereof, contained within the flexible capsule between the two ends in which an applied electrical current path through the conductive liquid composition exhibits a switching from conductivity to resistivity when subject to an effective amount of constriction transverse to the length of the flexible capsule and transverse to the direction of the electrical current applied to the conductive liquid; (C) two electrodes, e.g., metal or alloy, having an annulus substantially surrounding the two ends of the flexible capsule, the two electrodes being electrically connected to the conductive liquid composition and electrically connectable to a source of electrical power to cause a current to pass through the conductive liquid composition, and each annulus of the two electrodes being sealed by a flexible membrane, e.g., an elastomeric membrane; (D) an elongated insulating housing having a length and two ends, the housing containing the flexible capsule, the housing being closed at both ends by the two sealed electrodes; (E) a quantity of a magnetizable fluid, e.g., a ferromagnetic fluid, contained within the housing, the magnetizable fluid generally surrounding the flexible capsule containing the conductive liquid and being electromagnetically connected to means for generating a magnetic field in the fluid e.g. , the current flow through the conductive liquid or a coil disposed in the magnetizable fluid along length of capsule and electrically connected to the electrodes; (F) an elongated resistor having a length and two ends, the resistor generally surrounding the insulating housing and electrically connected to the two electrodes; and, (G) means for commutating the applied current to the resistor, e.g., auxiliary contacts or switch in series with electrodes or constriction of flexible capsule, in which an excessive current when applied to the electrical circuit protection device generates a magnetic field transverse to the direction of the applied current flowing through the conductive liquid composition along the length of the flexible capsule causing the ferromagnetic fluid to redistribute and deform the flexible capsule by transverse contraction and axial expansion to cause a switching of the current path through the conductive liquid between the electrodes from conductivity to resistivity and a comminuting of the excessive current to the resistor to effectively limit the let through current to a safe value. The electrical circuit protection device can be used in an electrical circuit alone or in conjunction with other current limiters, for instance circuit breakers.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENT OF THE INVENTION

Figure 1:
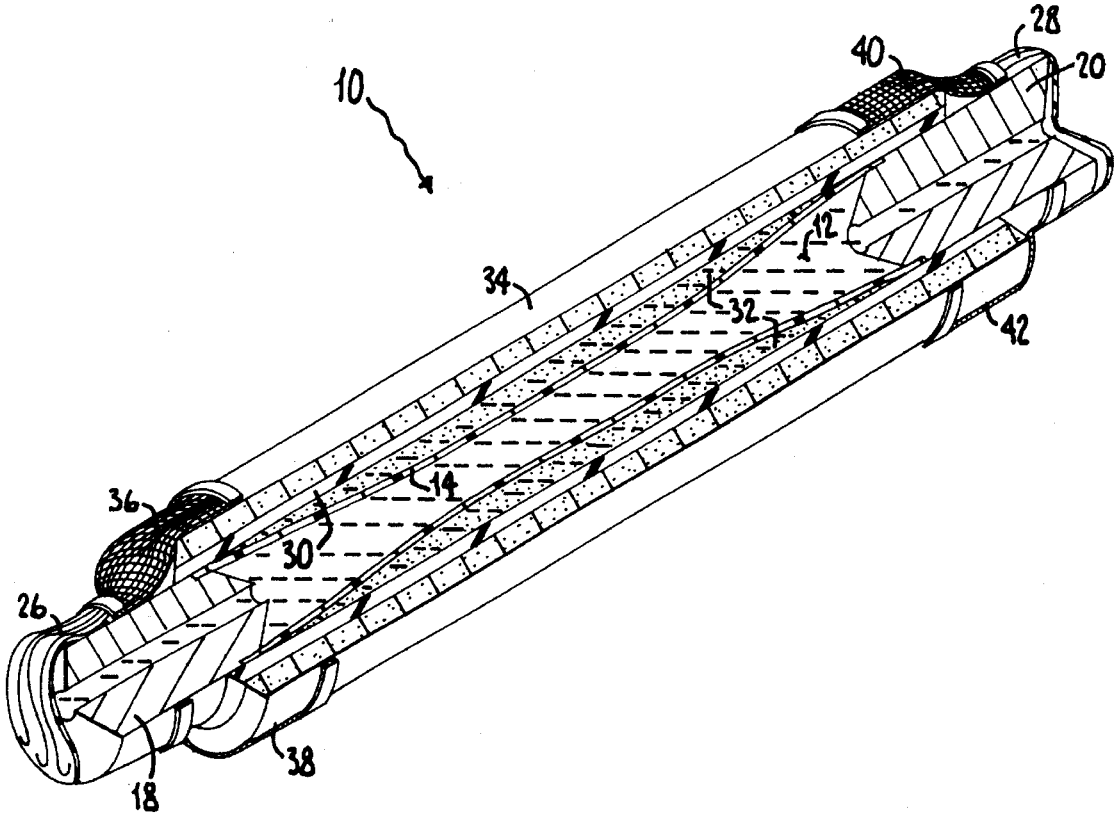
FIG. 1 is a perspective view of a circuit protection device of the invention cut away at a portion along the length.

The novel electrical circuit protection device of the invention includes a quantity of a conductive liquid composition contained in a conductive liquid device comprising a flexible, resilient, and compressible, elongated capsule, e.g., an elastomeric capsule, sealed at both ends by axially expansible electrodes, the electrodes being provided in intimate contact with the conductive liquid composition. The circuit protection devices of the invention further includes an enclosed magnetizable fluid, e.g., a ferromagnetic fluid, which surrounds the conductive liquid containing capsule, the magnetizable fluid being in intimate contact with the electrodes. When the circuit protection device is used as an electrical circuit component, the encapsulated conductive liquid composition of the device has low resistivity and readily carries a normal current. But when the current excessively increases due to an overload or a short circuit, the capsule and the conductive liquid composition contained within the capsule are compressed in a direction transverse to the current flow by an actuator, e.g., a ferromagnetic fluid subjected to a magnetic field, thereby constricting the current path through the liquid and sharply increasing the resistance of the device.

The ferromagnetic fluid is electromagnetically connected to a load sensing element which senses the magnitude of the applied current through the device and correspondingly generates a magnetic field transverse to the applied current in response to input electrical signals, thereby causing the ferromagnetic fluid to redistribute in the direction of the magnetic flux. The redistribution of the ferromagnetic fluid produces a distortion of the flexible capsule, i.e., radial contraction and axial expansion, which thereby reduces the cross-sectional area of the flexible capsule and the conductive liquid carrying the current and, consequently, causes the current path through conductive liquid to transform to a high resistance. The reduced cross-sectional area limits the let through current, either alone or preferably in conjunction with a shunt resistor and commutator, to a safe value until the excessive current or power is removed. When the excessive current or power is removed, the magnetic field is correspondingly removed along with the distortion force on the flexible capsule containing the conductive liquid. Accordingly, the encapsulated conductive liquid automatically reverts back to its original low resistance state. This invention has a specific application as an automatically resettable fuse or current limiter.

The electrical circuit protection device of this invention comprises conductive liquid compositions contained within a flexible, resilient and compressible capsule which can rapidly and effectively interrupt fault currents when used as a circuit component, thereby protecting other circuit components, e.g., wires and load, from damage. Unlike conventional current limiters, the device of the invention does not generate a significant arc and, therefore, does not have to be replaced after fault. The device of the invention automatically and readily returns to its original low resistance state after fault and is reusable and long lasting over a number of fault cycles. The device of the invention operates on magnitude of the current, and is, therefore, substantially unaffected by environmental conditions such as temperature, humidity, shock and vibrations unlike conventional current limiters.

Figure 2:
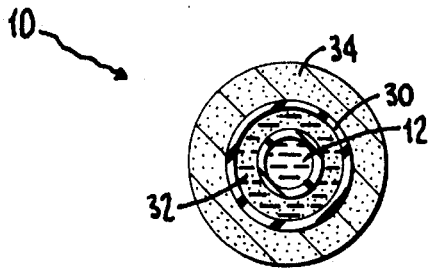
FIG. 2 is a cross sectional view of the circuit protection device of Figure along line A—A.

Referring now to FIG. 1 and FIG. 2, a circuit protection device 10 of the invention is illustrated. The circuit protection device 10 includes a conductive liquid 12 contained in a flexible, resilient and compressible capsule 14. The flexible capsule 14 can be made of an elastomeric composition, e.g., latex, silicone, ethylene poly(propylene) (EPR), poly(vinyl chloride) (PVC), styrene butadiene (SBR), and the like, or other materials having flexibility, resiliency, elasticity and durability under pressure. The capsule 14 is generally elongated along a length in the direction of an applied current flow, and, accordingly defines a hollow shell or cavity 16 for containing the conductive liquid 12. The flexible capsule 14 as shown in FIGS. 1 and 2 is generally cylindrical in shape having a radius and a length. Other configurations will become apparent from this disclosure or from a practice of the invention. The flexible capsule 14 is sized to permit enclosure of a quantity of a conductive liquid and is sufficiently flexible to allow contraction without breakage.

The flexible capsule 14 is provided at both ends with electrodes 18 and 20 which are electrically connected to the conductive liquid and electrically connectable by terminal wires (not shown) to a load (not shown) and an electrical power source (not shown). The electrodes are electrically connected to the conductive liquid through intimate contact therewith. The electrodes are preferably made of metal, e.g., copper, nickel, aluminum, silver, platinum, tungsten, and the like, or alloys thereof. The electrodes 18 and 20 are preferably provided as annular rings having an annulus 22 and 24 which are sealed by flexible membranes 26 and 28, respectively, each membrane preferably being made of elastomeric compositions as described above, for axial expansion of the conductive liquid 12 through expansion of the membranes 26 and 28.

The capsule 14 containing the conductive liquid 12 and the electrodes 18 and 20 and seals 26 and 28, otherwise referred to as the conductive liquid module, is provided to act as a good conductor of current under normal steady-state conditions, but when a fault condition occurs, the capsule 14 is distorted through radial contraction, i.e., transverse to the direction of current flow, and axial expansion by an actuator sensitive to the magnitude of current, thereby constricting the current flow path through the conductive liquid and, accordingly, increasing the resistivity of the conductive liquid through constriction of the conductive path therethrough by an order of magnitude to safely reduce or cut off the let through fault current. The conductive liquid module can be provided as an interchangeable component of the device 10 which is removed and replaced upon exhaustion or decreased effectiveness The conductive liquid compositions 12, which are encapsulated in the capsule 14 and electrically connected to the electrodes 18 and 20 by intimate contact, are selected for having low resistivity under normal current conditions and also for exhibiting a sharp increase in resistivity as the cross-sectional area of the current path through the conductive liquid 12 is reduced. The conductive liquid compositions may have some positive temperature coefficient of resistance properties as well, although increase of resistance by reduction in the current path is preferred.

The conductive liquid compositions can be selected from the group of: (1) conductive particle dispersions (or, in other words, suspensions), preferably colloidal suspensions; (2) conductive ionic solutions, either anionic or cationic; (3) conductive polymer solutions; and, (4) conductive liquid metals. The conductive liquid compositions can also be a combination of any of the above described solutions.

The conductive liquid compositions can be made from conductive particle dispersions which are comprised of a dielectrically stable fluid having a plurality of conductive particles dispersed or suspended in the fluid. The conductive particles are preferably provided in the liquid suspension medium such that they do not have a tendency to settle out, remaining uniformly dispersed in the fluid medium. It is further preferred that the conductive particles be of a particle size to maintain the dispersion as a colloidal suspension of conductive particles. Moreover, in order to maintain a uniform dispersion or colloidal suspension of the conductive particles, any commonly used surfactant can be also included in the mixture. It is also preferred that the dielectric fluid used as the liquid suspension medium for the conductive particles is preferably preconditioned by applying a voltage across the fluid to break down the dielectric around the electrodes and/or the conductive particles, thereby allowing permanent conductance across the fluid.

The liquid medium of the conductive particles dispersions can comprise dielectric liquids of, for example, silicone oils, hydrocarbon oils, ester oils and the like, or mixtures thereof. Specific examples of dielectric silicone oils can include those based on silicone or siloxane polymers, such as methyl silicone polymers, methylphenyl silicone polymers, chlorophenylmethyl silicone polymers, polydimethyl siloxane polymers or copolymers thereof and the like. Specific examples of dielectric hydrocarbon oils can include those based on aliphatic, alicyclic and aromatic compounds, such as mineral oils or transformer oils and the like.

The conductive particles dispersed in the dielectric liquid suspension medium are selected from the group consisting of metal particles such as aluminum, copper, silver, and nickel particles, metal coated glass beads, metal coated mica flakes, metal coated fibers, graphite particles, carbon black particles, metal oxide particles and the like. The metal coated hollow particles, such as metal coated glass beads, are especially preferred since they readily float in solution.

The conductive particles preferably have a particle size of about 1 to 30 microns, preferably about 10 to 20 microns and can take on a variety of particle shapes such as spheres, flake, fiber, dendritic, popcorn, etc. The conductive particles are loaded in the liquid medium in an amount of about 10 to 40% (by volume), preferably about 10 to 25% (by volume). A colloidal suspension of conductive particles is especially preferred.

The conductive liquid compositions can also be made from conductive ionic or electrolyte solutions which are comprised of salts, preferably organometallic salts, most preferably quaternary organometallic salts, dissociated into ions in a polar solvent in order to act as an electrically conductive solution. Conductive particle filled systems are advantageous in that they are highly conductive but have certain drawbacks due to the tendency to separate out of solution which is disadvantageous for long term conductive liquid stability. On the other hand, conductive ionic solutions contain no conductive particles to separate out of solution and are, accordingly, homogeneous and stable solutions.

The organometallic ionic salts can be selected from the group of tetraphenyl phosphonium chloride, tetraphenyl phosphonium bromide, tetrabutyl arsonium chloride, triphenylbutyl arsonium iodide, methyltrioctyl phosphonium dimethylphosphate, tetrabutyl phosphonium acetate, tetraphenyl arsonium acetate, tetrabutyl ammonium chloride, benzylmethyl ammonium iodide, tetraphenyl stibonium bromide, tetraphenyl sodium boride, lithium hexafluoro phosphate and the like. These salts are preferably highly dissolved or dissociated in the liquid medium.

The liquid medium can be selected from solvents, preferably polar solvents of the group of water, dioxane, tetrahydrofuran (THF), ethanol, methanol, isopropanol, butyl alcohol, ethyl acetate, butyl acetate, acetonitrile, 2-ethyl-1-hexanol, glycerol, acetic acid, butyric acid, butyrulactone, ethylene carbonate, butyl phosphate, 2-pyrrolidinone, ethyl acetoacetate, dimethyl sulfoxide (DMSO), tetramethylene sulfone and the like. The ionic solutions can also optionally include conductive particles as previously described.

The salts are typically provided in the solution at a concentration of about 2 to 70% (by weight), preferably about 20 to 40% (by weight), and most preferably at as high a concentration as possible to effectively provide the desired electrical conductance without crystallization out of the solution.

The conductive liquid compositions can also be made from conducting polymers or oligomers, either in the liquid state or solubilized in a solvent, such as a polar solvent. Liquid conducting polymers or oligomers are also described in Yoshino, K., *Novel Electrical and Optical Properties of Liquid Conducting Polymers and Oligomers*, IEEE Trans. on Dielec. and Elec. Ins., Vol. 1, No. 3, pp. 353–364, June 1994, this disclosure being incorporated by reference herein in its entirety. Typically, the conducting polymers or oligomers have highly extended conjugated bonds in its backbone and are modified with long side chains, such as alkyl side chains, as substituents, which alter the properties of the conducting polymers or oligomers to being soluble (or changed to liquid) and also fusible.

Specific examples of electrically conducting polymers are poly (pyrroles), poly (anilines), poly (thiophenes), poly (-p-phenylene vinylenes), poly (3-alkyl thiophenes), poly (3-alkyl furans), poly (3-alkylselenophene), poly (9-alkyl fluorenes), poly (2,5-dialkoxy-p-phenylene vinylenes) and the like. These polymers can be synthesized by conventional chemical methods using catalyst such as $FeCl_3$ or by conventional electrochemical methods.

The solvent, preferably a polar solvent, used to solubilize the conducting polymers, if not in the liquid state already, can include water, dioxane, tetrahydrofuran (THF), ethanol, methanol, isopropanol, butyl alcohol, ethyl acetate, butyl acetate, acetonitrile, 2-ethyl-1-hexanol, glycerol, acetic acid, butyric acid, butyrulactone, ethylene carbonate, butyl phosphate, 2-pyrrolidinone, ethyl acetoacetate, dimethyl sulfoxide (DMSO), tetramethylene sulfone and the like. These conducting liquid polymers solutions can also optionally include conductive particles as previously described.

The conducting polymers which are solubilized are typically provided in the solution at a concentration of about 5 to 80% (by weight), preferably about 30 to 60% (by weight), and most preferably at as high a concentration as possible to effectively provide the desired electrical conductance without crystallization out of the solution.

The conductive liquid compositions can also be made from liquid metals, for example, mercury. Other types of conductive liquids can further be used as will become apparent from the examples above or from the practice of the invention. The conductive liquid compositions can even further be a combination of any of the conductive liquid compositions described above.

The conductive liquid, thus formed, preferably has a normal resistance of about 0.1 to 400Ω, preferably about 0.1 to 10 Ω.

A more detailed description of conductive liquid compositions which exhibit sharp increases in resistivity as the cross-sectional area of the liquid transverse to the direction of current flow across the liquid is reduced can be found in copending U.S. patent application Ser. No. 08/350,299, of Shea, Smith and Schoch, Jr. entitled *Conductive Liquid Compositions and Electrical Circuit Protection Devices Comprising Conductive Liquid Compositions*, filed on the same day as the subject U.S. Patent Application, the disclosure being incorporated by reference herein in its entirety.

The conductive liquid 12 has a resistivity of about 1 to 2000 milliohm-cm (mΩ-cm), preferably about 2 to 50 milliohm-cm. Upon fault, the conductive liquid 12 preferably has a resistance of about 0.05 to 1000 ohms (Ω), preferably about 0.1 to 100 ohms at its switching pressure and switching cross-sectional area.

The flexible capsule 14 is further disposed and sealed inside a solid walled outer housing 30 containing a ferromagnetic fluid 32. The solid walled outer housing 30 is preferably made of an insulation material, e.g., poly(acetal) (Delrin®), poly(vinyl chloride) (PVC), poly(ethylene), poly(propylene), poly(tetrafluoroethylene) (PTFE), and tetrafluoroethylene copolymers with perfluorovinyl ethers (Teflon®), styrene butadiene (SBR), and the like, for non-conductance of the current therethrough and confinement of the current. The solid walled housing 30 is sized to permit enclosure of the flexible capsule 14 and the ferromagnetic fluid 32 and is preferably generally cylindrical in shape. The ferromagnetic fluid 32 is sealed within the solid walled housing 30 preferably by the sealed electrodes 18 and 20 and the outer walls of the flexible capsule 14 disposed within the housing 30. The ferromagnetic fluid 32, therefore, surrounds the flexible capsule 14 containing the conductive liquid 12 and remains in intimate contact with the outside of the flexible capsule 14 along its length. The ferromagnetic fluid 32 is also connected to means for generating a magnetic field therein and transverse to the direction of current flow through the conductive liquid. As shown the means for generating a magnetic field are provided by the ferromagnetic fluid being in intimate contact with the flexible capsule 14 and the electrodes 18 and 20 and exposed to the magnetic field generated by the current flow through the conductive liquid 12 between the electrodes. Of course other magnetizing means can be positioned within the ferromagnetic fluid such as a coil (not shown) disposed in the fluid along the length of the flexible capsule and being electrically connected to the electrodes.

The ferromagnetic fluid 32 is preferably a colloidal, non-flocculating, suspension of magnetic particles, e.g., $Fe_3O_4$ (magnetite), $FeO_2$, or solid solutions of Fe—Si, Fe—B, Fe—Ni—Co, and Fe—Ni—Co—Si, and the like, dispersed in an inert liquid. Any known ferromagnetic fluid can be used. An example of a ferromagnetic fluid and magnetic field generation means can be found in U.S. Pat. No. 3,750,067 of Fletcher, et al. and entitled *Ferrofluidic Solenoid*, this disclosure being incorporated by reference herein in its entirety. Also other novel types of ferromagnetic fluids can be used with magnetic particles grafted directly on the carrier fluid molecules by exposing the particle fluid solution to a radiation source. This grafting provides a ferromagnetic fluid which responds to much lower magnetic fields, thereby increasing the strength of the ferromagnetic fluid 32 for deforming the flexible capsule 14. The ferromagnetic fluid preferably is formulated to have a fast acting response to an applied magnetic field in order to provide for fast current limiting effects. Other types of magnetizable fluids can be used as well.

The ferromagnetic fluid 32 is, therefore, provided as the electromechanical actuator for producing a mechanical force, i.e., a distortion force, on the flexible capsule 14 contained in the housing 30 in response to electrical currents applied thereto, thereby causing the conductive liquid 12 contained in the capsule to transform from conductance to resistance along the path of the current during fault conditions. The ferromagnetic fluid provides a distortion force on the flexible capsule transverse to the direction of current flow in response to a magnetic field generated by the fault current. The ferromagnetic fluid 32 is preferably electromagnetically connected to the electrodes 18 and 20 and conductive liquid 12 and is responsive to electrical currents through the conductive liquid which generate a magnetic field transverse to the direction of current flow through the conductive liquid.

The housing 30 made of an insulation material is generally surrounded by a low inductance resistor 34, otherwise referred to herein as a shunt resistor, which capable of absorbing high energies. In the embodiment shown in FIG. 1, the resistor 34 is sized to house the entire assembly of the device 10 and is generally tubular in shape. The resistor is electrically connected by lead wires 36, 38, 40 and 42, e.g., wire braids, to the electrodes 18 and 20. A suitable high power cylindrical resistor, e.g., 1" diameter as type made by Carborundum Co. of Niagara Falls, N.Y. can be used as the energy absorbing element 34. The resistance values of such a resistor 34 are typically about 0.5Ω to 1000Ωft depending on the application and on the conductive liquid's ability to commutate the current to the resistor when the conductive liquid is in a state of high resistance. A switch 46 or auxiliary contacts can be connected in series to the electrodes of the flexible capsule which can completely clear the load from any line voltage and remove any residual current from the conductive liquid and shunt resistor. Also, as shown in phantom in FIGS. 3 and 4, a solid wire 44 of an appropriate length and diameter made from a resistive material e.g., nichrome, iron, nickel and the like, can be used in place of resistor 34 to give an appropriate resistance (i.e., greater than about 0.1Ω).

Figure 3:
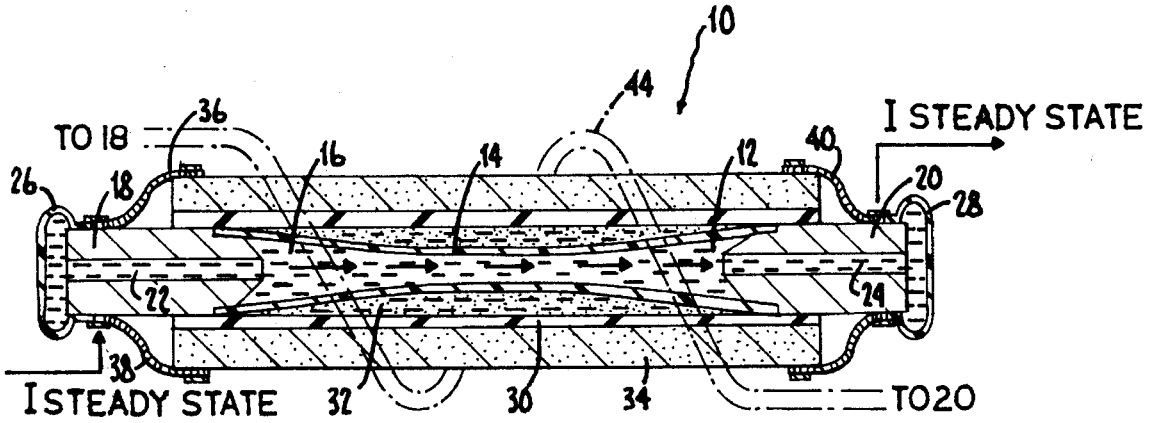
FIG. 3 is a cross-sectional view of the circuit protection device of Figure along line B—B and carrying a normal steady-state current.

Referring now to FIG. 3, the figure shows the current protection device 10 of the invention having a current applied thereto by being attached by lead wires (not shown) or the like to an electrical circuit (not shown) including a power source (not shown) and a load (not shown). As shown in FIG. 3, under normal steady-state conditions, a current, being shown as $I_{STEADY\text{-}STATE}$, generated from the power source flows across the load circuit and across the electrodes 18 and 20 and flows through the conductive liquid 12 along the axial length of the flexible capsule 14 positioned therebetween in a low resistance state, typically having a resistance of about 1 to 50 mΩ, preferably about 2 to 20 mΩ. The ferromagnetic fluid 32 is uniformly distributed around the flexible capsule 14 leaving the flexible capsule 14 in a relaxed condition.

Figure 4:
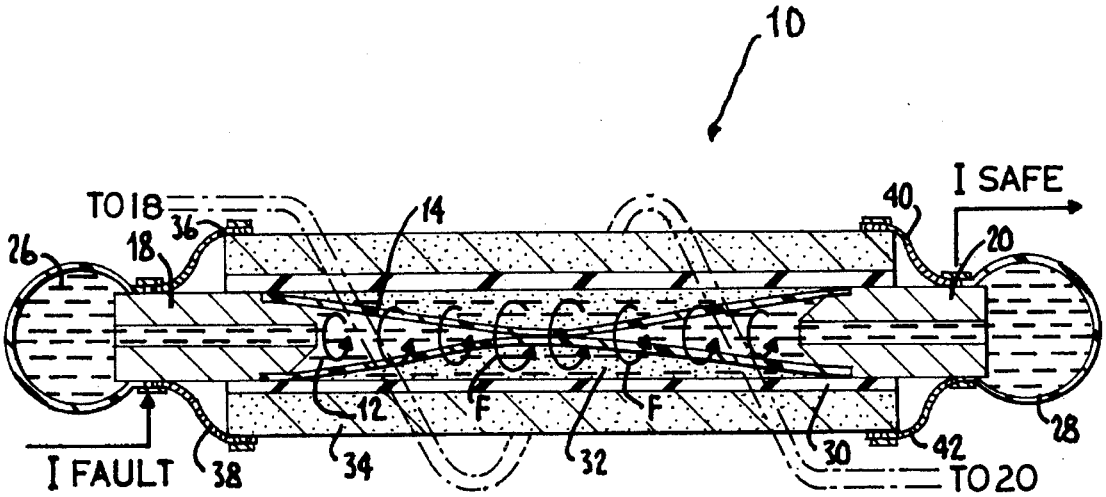
FIG. 4 is a cross-sectional view of the circuit protection device of Figure along line B—B and carrying a fault current.

Referring now to FIG. 4, a fault current, being shown as $I_{FAULT}$, due to, for example, an overload or short circuit is rapidly sensed by the ferromagnetic fluid 32 electromagnetically connected to the conductive liquid 12 through the generation of a strong magnetic field from the excessive current passing through the conductive liquid. The excessive fault current passing through the conductive liquid 12 between the electrodes 18 and 20 rapidly creates a magnetic field, the flux lines being shown as F, of which flow in the direction generally perpendicular to the fault current $I_{FAULT}$ and, accordingly, in the direction generally transverse to the current flow through the conductive liquid 12 contained in a flexible capsule 14. The magnetic field F operates to, in effect, redistribute the ferromagnetic fluid 32 to thereby deform the shape of the flexible capsule 14. As shown in FIG. 4, this deformation of the flexible capsule 14 is characterized by having the flexible membrane ends 26 and 28 expand and protrude through the ends of the electrodes 18 and 20 and by having the central wall area of the flexible capsule 14 withdrawal transverse to the direction of current flow through the liquid, i.e., radial compression and axial expansion. Of course, the stronger the magnetic field created by the fault current input, the more pronounced will be the deformation of the capsule 14.

The radial contraction and axial expansion of the capsule 14 greatly reduces the cross-sectional area of the conductive liquid 12, thereby sharply increasing the resistance of the conductive liquid to about 0.1 to 1000Ω, preferably about 10 to 100Ω to limit the let through current to a safe value. In the preferred arrangement as shown, the radial contraction is to such an extent that the current flow path across the conductive liquid 12 is effectively pinched off completely, thereby causing an increase in resistance of the conductive liquid and allowing little or no current to pass therethrough. The current is commutated by the constriction of the conducting liquid to the low inductance resistor 34 or shunt resistor 44, thereby reducing or limiting the let through current to a safe value and protecting the load. Complete clearing of the current is achieved by opening switch 46 by the mechanical trip mechanism.

Once the excessive fault current is removed, the flexible membranes 26 and 28 automatically relax to their original position and force the ferromagnetic fluid 32 and the conductive liquid 12 back to its original position, and, accordingly, the conductive liquid 12 reverts back to a state of low resistance for normal steady-state current conduction. The circuit protection device is automatically resettable and produces reliable operation over a plurality of fault cycles. The ferromagnetic fluid 32 is a fast acting actuator and rapidly causes reduction of the let through current upon fault through rapid radial compression of the capsule 14 containing the conductive liquid 12.

Figure 6A:
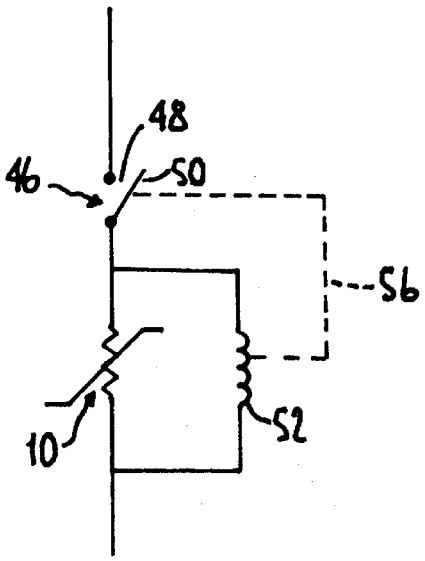
FIGS. 6*a*, 6*b* and 6*c* is an illustration of the circuit protection device of the invention applied to a circuit breaker.
Figure 6B:
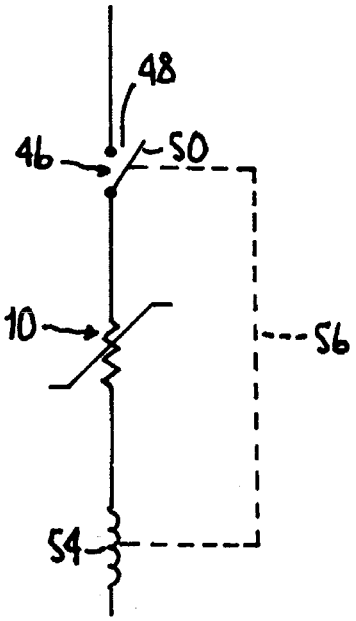
Figure 6C:
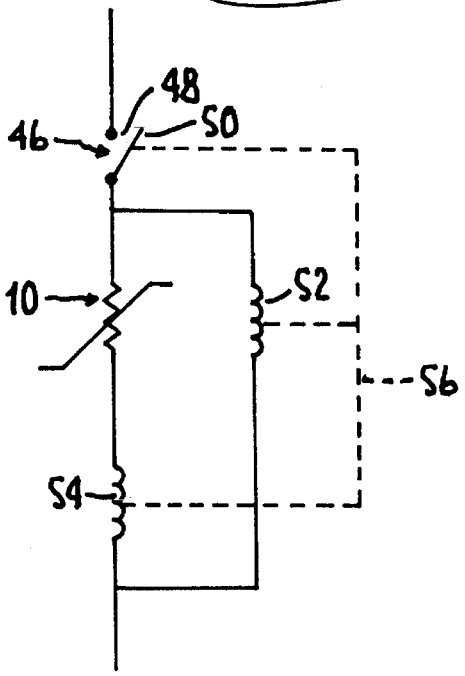

Once the fault is limited, a circuit breaker or auxiliary contacts as shown in FIG. 6 can be used in conjunction with the circuit protection device 10 which can easily be opened and cleared to fully isolate the load. A high impedance coil can be placed in parallel with the circuit protection device to trip the breaker contacts (FIG. 6*a*). A low impedance coil can be placed in series with the circuit protection device to also trip the breaker contacts (FIG. 6*b*). Moreover, a combination of FIGS. 6*a* and 6*b* can also be used (FIG. 6*c*). This embodiment is more fully described below.

While not wishing to be bound by theory, it is believed that the basis for the resistance change in the conductive liquid, can be estimated from the following equations:

$$R=\rho l/A \tag{1}$$

where R is resistance, p is resistivity of the conductive liquid, 1 is conductor length, and A is the cross-sectional area of the encapsulated conductive liquid. The approximate cross-sectional areas for an effective circuit protection or current limiter device comprising conductive liquids can be determined using the following ratio derived from Equation (1):

$$R_{on}/R_{off}=l_{on}A_{off}/l_{off}A_{on} \tag{2}$$

Assuming a cylindrical geometry of the capsule with $l_{on}=1_{off}$, equal resistivity for the on condition and off condition, and $A_{off}/A_{on}=(r_{on}/r_{on})^2$, where r is the radius of the cylinder, $R_{off}$ is the constricted radius and ron is the unconstricted radius, then Equation (2) can be rewritten as:

$$R_{on}/R_{off}=(r_{off}/r_{on})^2 \tag{3}$$

and the resistivity of the conductive liquid can be written as:

$$\rho=R_{on}A_{on}/l_{on} \tag{4}$$

Using these equations, Table 1 below shows the resulting constriction radius ($r_{off}$) over a range of off resistance values ($R_{off}$) for two typical on resistance values ($R_{on}$). Power dissipated is the route mean square (rms) off current×440 $V_{rms}$ using a 440 V AC circuit as an example.

TABLE 1

| Resistance On (mΩ) | Radius On (cm) | Resistivity ($l_{on}$–5 cm) (Ω-cm) | Resistance Off (Ω) | Radius Off (mm) | Power Dissipated (kW) |
|---|---|---|---|---|---|
| 10 | 0.5 | $1.6 \times 10^{-3}$ | 0.1 | 1.6 | 1936.0 |
| 10 | 0.5 | | 1.0 | 0.5 | 194.0 |
| 10 | 0.5 | | 10.0 | 0.16 | 19.4 |
| 10 | 0.5 | | 100.0 | 0.05 | 1.9 |
| 10 | 0.5 | | 1000.0 | 0.016 | 0.19 |
| 10 | 0.5 | | 10000.0 | 0.005 | 0.019 |
| 50 | 0.5 | $7.9 \times 10^{-3}$ | 0.1 | 3.54 | 1936.0 |
| 50 | 0.5 | | 1.0 | 1.12 | 194.0 |
| 50 | 0.5 | | 10.0 | 0.35 | 19.4 |
| 50 | 0.5 | | 100.0 | 0.11 | 1.9 |
| 50 | 0.5 | | 1000.0 | 0.035 | 0.19 |
| 50 | 0.5 | | 10000.0 | 0.011 | 0.019 |

Some factors which need to be considered when designing the circuit protection device comprising conductive liquid compositions and a ferromagnetic actuator of the invention are: (a) required constriction radius ($r_{off}$) of the flexible capsule, e.g., a cylindrical and elastomeric capsule, which effectively reduces the cross-sectional area of the conductive liquid compositions to constrict the current flow and create high resistance in the liquid, thereby minimizing the let through current; (b) ferromagnetic fluid reaction time to magnetic fields, which determines the reaction time of the trip caused by a fault current and also prevents vaporization of the liquid from excessive resistive heating ($I^2R$) and, consequently, prevents destruction of the current limiter during switching processes; and (c) conductive liquid composition, i.e., resistivity, viscosity, conductive particle size, conductive particle shape, stability, etc. It is desirable to maximize the off resistance by minimizing the constriction radius which would minimize the power dissipated in the conducting liquid.

Figure 5A:
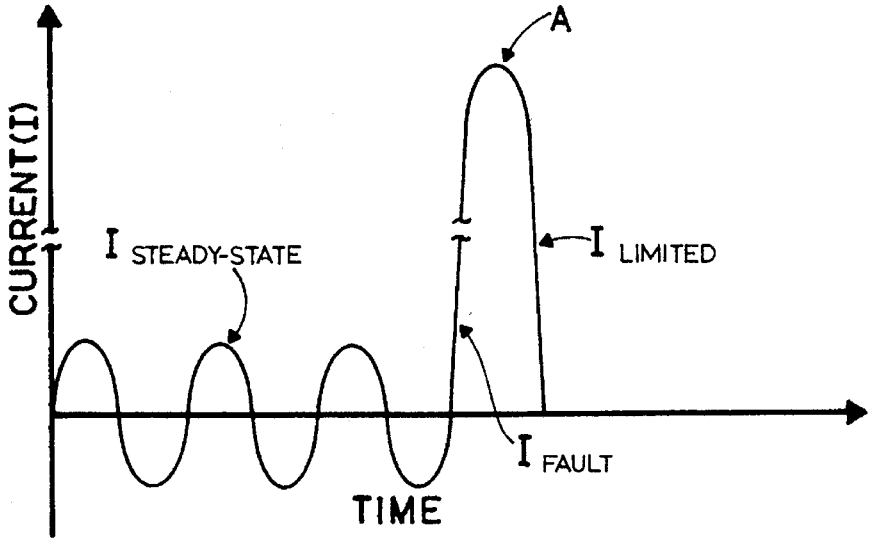
FIG. 5 is a graphical illustration of the switching characteristics of the circuit protection device of the invention during fault current conditions; and, FIG. 6 including
Figure 5B:
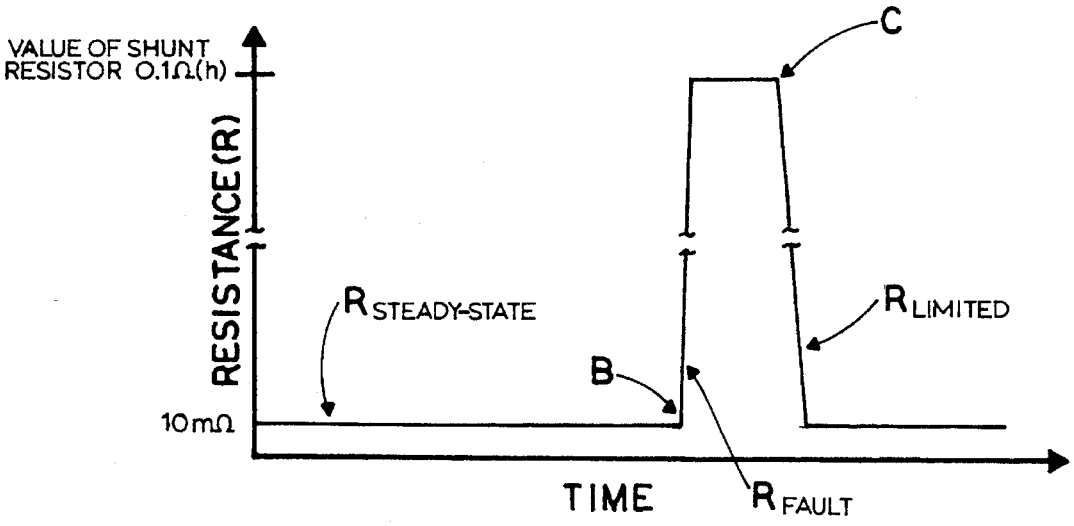

Referring now to FIG. 5, a graphical illustration of the switching characteristics of the circuit protection device of the invention during fault is shown.

Referring now to FIG. 6 including FIGS. 6*a*, 6*b* and 6*c*, this Figure shows how to place a circuit protection device 10 of the invention inside a conventional circuit breaker 46 including contacts 48 and 50 to create or enhance the current limiting capability of the breaker. As shown in FIG. 6*a*, a high impedance coil 52 can be placed in parallel with the circuit protection device 10 to trip the breaker contacts 48 and 50. As shown in FIG. 6*b*, a low impedance coil can be placed in series with the circuit protection device 10 to also trip the breaker contacts 48 and 50. As shown in FIG. 6*c*, a combination of the arrangements of FIGS. 6*a* and 6*b* including both a high impedance coil 52 and a low impedance coil 51 can be used to trip the breaker contacts 48 and 50.

The invention having been disclosed in connection with the foregoing variations, additional variations will now be apparent to persons skilled in the art. The invention is not intended to be limited to the variations specifically mentioned, and accordingly reference should be made to the appended claims rather than the foregoing discussion of preferred variations, to assess the spirit and scope of the invention in which exclusive rights are claimed.

We claim:

1. An electrical circuit protection device, which comprises:

(a) an elongated flexible capsule having a length and two ends;

(b) an effective amount of a conductive liquid composition contained within the flexible capsule between the two ends, the conductive liquid being capable of carrying an applied current and switching the current path therein from conductivity to resistivity when subject to an effective amount of constriction transverse to the length of the flexible capsule and transverse to the direction of the electrical current applied to the conductive liquid;

(c) two electrodes having an annulus substantially surrounding the two ends of the flexible capsule, the two electrodes being electrically connected to the conductive liquid composition and electrically connectable to a source of electrical power to cause a current to pass through the conductive liquid composition, and each annulus of the two electrodes being sealed by a flexible membrane;

(d) an elongated insulating housing having a length and two ends, the housing containing the flexible capsule, the housing being closed at both ends by the two sealed electrodes;

(e) an effective amount of a magnetizable fluid composition contained within the housing and generally surrounding the flexible capsule, the magnetizable fluid being electromagnetically connected to the two electrodes; and, (f) an elongated resistor having a length and two ends, the resistor generally surrounding the insulating housing and electrically connected to the two electrodes, in which an excessive current when applied to the electrical circuit protection device generates a magnetic field transverse to the direction of the applied current flowing through the conductive liquid composition along the length of the flexible capsule causing the ferromagnetic fluid to redistribute and deform the flexible capsule by transverse contraction and axial expansion to cause a switching of the current path through the conductive liquid between the electrodes from conductivity to resistivity and a commutating of the excessive current to the resistor to effectively limit the let through current to a safe value.

2. The electrical circuit protection device of claim 1, in which the device is generally cylindrical in shape.

3. The electrical circuit protection device of claim 1, in which the flexible capsule and flexible membranes comprise elastomeric materials.

4. The electrical circuit protection device of claim 3, in which the elastomeric materials are selected from the group of elastomers consisting of latexes, silicones, ethylene polypropylenes, polyvinyl chlorides, and styrene butadienes.

5. The electrical circuit protection device of claim 1, in which the magnetizable fluid comprises ferromagnetic particles selected from the group consisting of $Fe_3O_4$ and $FeO_2$ and solid solutions of Fe—Si, Fe—B, Fe—Ni—Co, and Fe—Ni—Co—Si, dispersed in an inert liquid.

6. The electrical circuit protection device of claim 1, in which the conductive liquid composition is selected from the group consisting of conductive particle dispersions, conductive ionic solutions, conductive polymer solutions, and conductive liquid metals.

7. The electrical circuit protection device of claim 6, in which the conductive liquid composition comprises a conductive particle dispersion which comprises:

(a) a dielectric fluid; and, (b) a plurality of conductive particles dispersed in the dielectric fluid.

8. The electrical circuit protection device of claim 7, in which the conductive particles are selected from the group consisting of carbon black, graphite, metal, metal oxide, and metal coated particles.

9. The electrical circuit protection device of claim 7, in which the dielectric fluid is selected from the group consisting of silicon oil, hydrocarbon oil, mineral oil, transformer oil, and ester oil.

10. The electrical circuit protection device of claim 7, in which the conductive particles are loaded in the dielectric fluid in a concentration of about 10 to 40% (by volume) based on the total volume of the conductive particle dispersion.

11. The electrical circuit protection device of claim 7, in which the conductive particle dispersion is a colloidal suspension of the conductive particles.

12. The electrical circuit protection device of claim 6, in which the conductive liquid composition comprises a conductive ionic solution which comprises:

(a) a solvent; and, (b) an organometallic salt dissociated in the solvent.

13. The electrical circuit protection device of claim 12, in which the solvent comprises a polar solvent selected from the group consisting of water, dioxane, tetrahydrofuran, ethanol, methanol, isopropanol, butyl alcohol, ethyl acetate, butyl acetate, acetonitrile, 2-ethyl-1-hexanol, glycerol, acetic acid, butyric acid, butyrulactone, ethylene carbonate, butyl phosphate, 2-pyrrolidinone, ethyl acetoacetate, dimethyl sulfoxide, and tetramethylene sulfone.

14. The electrical circuit protection device of claim 12, in which the organometallic salt is selected from the group consisting of tetraphenyl phosphonium chloride, tetraphenyl bromide, tetrabutyl arsonium chloride, triphenyl arsonium iodide, methyltrioctyl phosphonium dimethylphosphate, tetrabutyl phosphonium acetate, tetraphenyl arsonium acetate, tetrabutyl ammonium chloride, benzylmethyl ammonium iodide, tetraphenyl stibonium bromide, tetraphenyl sodium boride, and hexafluoro lithium phosphate.

15. The electrical circuit protection device of claim 12, in which the salt is provided in a concentration of about 2 to 70% (by weight).

16. The electrical circuit protection device of claim 6, in which the conductive liquid composition comprises a conductive polymer solution which comprises:

(a) a solvent; and, (b) a conducting polymer or oligomer dissolved in the solvent.

17. The electrical circuit protection device of claim 16, in which the solvent comprises a polar solvent selected from the group consisting of water, dioxane, tetrahydrofuran, ethanol, methanol, isopropanol, butyl alcohol, ethyl acetate, butyl acetate, acetonitrile, 2-ethyl-1-hexanol, glycerol, acetic acid, butyric acid, butyrulactone, ethylene carbonate, butyl phosphate, 2-pyrrolidinone, ethyl acetoacetate, dimethyl sulfoxide, and tetramethylene sulfone.

18. The electrical circuit protection device of claim 16, in which the conducting polymer or oligomer is selected from the group consisting of poly(pyrroles), poly(anilines), poly(thiophenes), poly(-p-phenylene vinylenes), poly(3-alkylthiophenes), poly(3-alkylfurans), poly(3-alkylselenophenes), poly(9-alkylfluorenes), and poly(2,5 -dialkoxy-p-phenylene vinylenes).

19. The electrical circuit protection device of claim 16, in which the conducting polymer or oligomer is provided in a concentration of about 5 to 80% (by weight).

20. The electrical circuit protection device of claim 6, in which the conductive liquid composition comprises a liquid metal.

21. The electrical circuit protection device of claim 20, in which the liquid metal comprises liquid mercury.

22. The electrical circuit protection device of claim 1, in which the resistor is a shunt resistor.

23. The electrical circuit protection device of claim 1, in which the device is liable to faults of a voltage of 600 volts or lower.

24. The electrical circuit protection device of claim 1, in which the device is electrically connected to a circuit breaker.

25. An electrical circuit, which comprises:

(a) an electrical power source having a voltage;

(b) an electrical load; and, (c) an electrical circuit protection device, which comprises:

(i) an elongated elastomeric flexible capsule having a length and two ends;

(ii) a conductive liquid composition contained within the flexible capsule between the two ends, the conductive liquid being capable of carrying an applied current and switching the current path therein from conductivity to resistivity when subject to an effective amount of constriction transverse to the length of the flexible capsule and to the direction of an electrical current applied to the conductive liquid;

(iii) two metal or alloy electrodes having an annulus and substantially surrounding the two ends of the flexible capsule, the two electrodes being electrically connected to the conductive liquid and electrically connected to the power source of electrical power and the load to cause a current to pass through the conductive liquid from the power source to the load, and each annulus of the two electrodes being sealed by an elastomeric flexible membrane;

(iv) an elongated insulating housing having a length and two ends, the housing containing the flexible capsule, the housing being closed at both ends by the two electrodes;

(v) a ferromagnetic fluid composition contained within the housing and generally surrounding the flexible capsule, the ferromagnetic fluid being electromagnetically connected to the two electrodes; and, (v) an elongated shunt resistor having a length and two ends, the resistor generally surrounding the insulating housing and electrically connected to the two electrodes, in which a trip current when applied to the electrical circuit generates a magnetic field transverse to the direction of the applied current flowing through the conductive liquid causing the ferromagnetic fluid to redistribute and deform the flexible capsule by transverse contraction and axial expansion to cause a switching of the conductive path through the conductive liquid from conductivity to resistivity and a commutating of the trip current to the shunt resistor to effectively limit the let through current to a safe value.

26. The electrical circuit of claim 25, in which the circuit protection device is generally cylindrical in shape.

27. The electrical circuit of claim 25, in which the device is liable to faults of a voltage of 600 volts or less.

28. The electrical circuit of claim 25, in which the circuit further comprises a circuit breaker electrically connected to the electrical circuit protection device.

29. A method of limiting a current, comprising:

(a) providing a flexible capsule having a cavity;

(b) filling the cavity of the flexible capsule with a conductive liquid which exhibits a switching from conductivity to resistivity when subject to an effective amount of constriction transverse to the direction of an electrical current applied to the conductive liquid;

(c) sealing the capsule by two electrodes electrically connected to the conductive liquid and electrically connectable to a source of electrical power to cause an applied current to pass through the conductive liquid; and, (d) providing an electromechanical actuator used to produce a mechanical deformation force on the flexible capsule mechanically connected to the flexible capsule and electrically connected to the electrodes, in which the actuator when subject to an excessive current having a trip voltage deforms the flexible capsule by contraction transverse to the direction of current flow in the conductive liquid to cause a switching of the current path through the conductive liquid from conductivity to resistivity to limit the let through current to a safe value.

30. The method of claim 29, in which the method further comprises:

(e) providing a shunt resistor generally surrounding the housing and electrically connected to the electrodes, in which the excessive current is commutated to the resistor which limits the let through current to a safe value.

31. The method of claim 29, in which part (d) further comprises:

(d.1) providing a ferromagnetic liquid generally surrounding the flexible capsule and both being contained within an insulating housing sealed by the electrodes, in which the excessive current generates a magnetic force which redistributes the ferromagnetic fluid transverse to the direction of current flow and deforms the flexible capsule.

* * * * *